US005700010A

United States Patent [19]

Mimier

[11] Patent Number: 5,700,010

[45] Date of Patent: Dec. 23, 1997

[54] METHOD OF PLAYING A DICE WAGERING GAME

[76] Inventor: Robert F. Mimier, 915 W. Fifth St., Marshfield, Wis. 54449

[21] Appl. No.: 778,959

[22] Filed: Jan. 6, 1997

[51] Int. Cl.[6] ..... A63F 9/04

[52] U.S. Cl. ..... 273/292; 273/274

[58] Field of Search ..... 273/274, 292, 273/146

[56] References Cited

U.S. PATENT DOCUMENTS

| | | | |
|---|---|---|---|
| D. 211,592 | 7/1968 | Schultz . | |
| D. 212,294 | 9/1968 | Schultz . | |
| D. 212,295 | 9/1968 | Schultz . | |
| D. 213,891 | 4/1969 | Schultz . | |
| D. 214,248 | 5/1969 | Schultz . | |
| D. 214,249 | 5/1969 | Schultz . | |
| D. 214,250 | 5/1969 | Schultz . | |
| 1,466,534 | 8/1923 | Kuen . | |
| 3,399,897 | 9/1968 | Mitchell | 273/274 |
| 3,904,208 | 9/1975 | Grossman . | |
| 4,232,866 | 11/1980 | Pennachio . | |
| 4,334,686 | 6/1982 | Pennachio . | |
| 4,346,900 | 8/1982 | Lamlee . | |
| 4,635,938 | 1/1987 | Gray . | |
| 4,711,453 | 12/1987 | Saint Ive . | |
| 4,720,108 | 1/1988 | Gramera . | |
| 4,900,034 | 2/1990 | Bereuter . | |
| 5,011,160 | 4/1991 | Lacza . | |
| 5,031,914 | 7/1991 | Rosenthal . | |
| 5,106,091 | 4/1992 | Comito . | |
| 5,133,559 | 7/1992 | Page . | |
| 5,265,881 | 11/1993 | Doherty . | |
| 5,308,081 | 5/1994 | Bartle . | |
| 5,350,175 | 9/1994 | DiLullo et al. . | |
| 5,413,351 | 5/1995 | Franklin . | |
| 5,456,467 | 10/1995 | Hoover . | |
| 5,490,670 | 2/1996 | Hubert | 273/274 |

*Primary Examiner*—William M. Pierce
*Attorney, Agent, or Firm*—Lathrop & Clark

[57] ABSTRACT

A dice game employing a single die. The shooter rolls the die a number of times until either the same die face is rolled twice or until each of the die faces one through six have been rolled, in either case the shooter's turn ends. The primary bets which may be placed with the house are, that a particular number will be rolled before the shooters turn ends. Primary bets pay 2 for 1. If the shooter's turn ends after all six dice faces have been rolled, all primary bets winnings are doubled or tripled by the house. A second set of bets is based on at least three, four, five, or six dice being rolled before the end of the shooters turn and in addition having a particular pattern such as the dice rolls all being sequentially higher or lower than the previous roll. These bets have odds ranging from 5 for 1 to 25,000 for 1. The primary and secondary type of bets are placed before a turn is begun. During the play of a particular turn bets may be placed on the outcome of the next roll of the die which results in a return of 5 for 1. Additional bets which may be placed are where the first two or more rolls are specified exactly. Lastly, bets may be placed on the number of successful rolls.

21 Claims, 3 Drawing Sheets

50

| First Roll | Second Roll | Third Roll | Fourth Roll | Fifth Roll | Sixth Roll |
|---|---|---|---|---|---|
| 6 | 6 | 6 | 6 | 6 | 6 |
| 5 | 5 | 5 | 5 | 5 | 5 |
| 4 | 4 | 4 | 4 | 4 | 4 |
| 3 | 3 | 3 | 3 | 3 | 3 |
| 2 | 2 | 2 | 2 | 2 | 2 |
| 1 | 1 | 1 | 1 | 1 | 1 |

FIG. 2

METHOD OF PLAYING A DICE WAGERING GAME

FIELD OF THE INVENTION

This invention relates to games of chance in general and games of chance employing dice in particular.

BACKGROUND OF THE INVENTION

Dice are one of the oldest gaming implements, having existed in substantially their current form for over 2,000 years. During the 20th century, a game played exclusively with dice called "Craps" or "Crapshooting" has risen in popularity to become the game which attracts the largest betting in American gambling houses.

The dice used to play Craps have the shape of a cube approximately ⅝ inches on a side. The faces of the dice are marked with dots (pips) on each of the six faces. Each face has a number of dots between one and six with each number being used only once. Opposite faces have numbers which add up to seven and if the vertical face towards you is five the horizontal face on top of the die is six, the three should be on the vertical face to your right.

In Craps when played at a casino, the dice shooter places a bet with the house. The shooter then rolls two dice against a backstop or wall, if a seven or eleven is rolled the shooter has rolled a "natural" and wins. If two, three or twelve is rolled the shooter "Craps" out and loses all bets. If any other number is rolled, this becomes the shooter's "point." The shooter then continues to throw the dice until the game is settled. The shooter wins if the shooter rolls their "point" before throwing a seven; throwing a seven causes the shooter to loose.

Many additional bets may be placed by the shooter or other players who place bets with the house on the outcome of the shooter's game. Examples of bets which typically may be placed are: what the next roll will be; that the player will make their point of four, six, eight or ten by throwing doubles; or that a particular sequence of dice will be rolled. Craps allows essentially every combination which may be thrown to be bet on, if house rules provide odds for that bet. The house sets the payout on each possible bet, with the odds giving the house a larger or smaller advantage against the players.

Craps is a game which developed from the old English game of "Hazard," and has a history of play between individuals with a result that it is less than ideally suited to the modern gambling casino. Historically, craps gives an advantage to the player who correctly knows the odds and bets accordingly. When played in a casino, the odds are set by the house and the advantage of knowing the odds is less because the house always has the advantage. Modern casino gambling is seen as a form of entertainment where simplicity, continuity and the possibility of high return bets are important in providing a level of excitement which provides the entertainment value of the game.

Craps suffers from a confusing number and type of bets. When shooters are rolling the dice to make their point, if they fail to roll their point, or to roll a seven, the roll of the dice does not progress towards any conclusion of the game. Further, the highest return on a single bet in a game of Craps is typically less than 30 to 1.

There have been many fascinating attempts to address this opportunity created by craps's complexity and potential for throws which do not progress the game towards a conclusion. Examples of dice games include U.S. Pat. Nos. 5,265,881 to Doherty; 5,350,175 to DiLullo et al.; 5,413,351 to Franklin; and 5,308,0812 Bartle. But the common feature of these dice games is that they continue to have some or all of the problem associated with Craps itself.

What is needed is a dice game suitable for play against a casino house, which provides better entertainment value by providing a game of greater continuity, simplicity and excitement.

SUMMARY OF THE INVENTION

The dice game of this invention employs a single die. The shooter rolls the die a number of times until either the same die face is rolled twice, or until each of the die faces one through six have been rolled; in either case, the shooters turned ends. The first type of bets which may be placed with the house are that a particular number will be rolled before the shooter's turn ends. Winning bets of the first type pay 2 for 1. If the shooter's turn ends after all six dice faces have been rolled, all of the first type bets winning are doubled or tripled by the house. A second set of bets is based on at least three, four, five, or six dice being rolled before the end of the shooters turn and, in addition, having a particular pattern such as the dice rolls all being sequentially higher or lower than the previous roll. These bets have odds ranging from 5 for 1 to 25,000 for 1. The first type and second type of bets are placed before a turn is begun. During the play of a particular turn bets may be placed on the outcome of the next roll of the die, which results in a return of 5 for 1 if the next roll of the dice is correctly predicted.

Additional bets which may be placed are where the first two or more rolls are specified exactly. Lastly, bets may be placed on the number of successful rolls.

It is an object of the present invention to provide a dice game with improved continuity of excitement as the game is played.

It is another object of the present invention to provide a dice game with better entertainment value.

It is a further object of the present invention to provide a dice game with some bets providing large payout odds.

It is yet a further object of the present invention to provide a dice game which is more easily understood by the casual player.

BRIEF DESCRIPTION OF THE DRAWINGS

FIG. 2 is an elevational view of a display board for use with the game of this invention.

DESCRIPTION OF THE PREFERRED EMBODIMENTS

Figure 1:
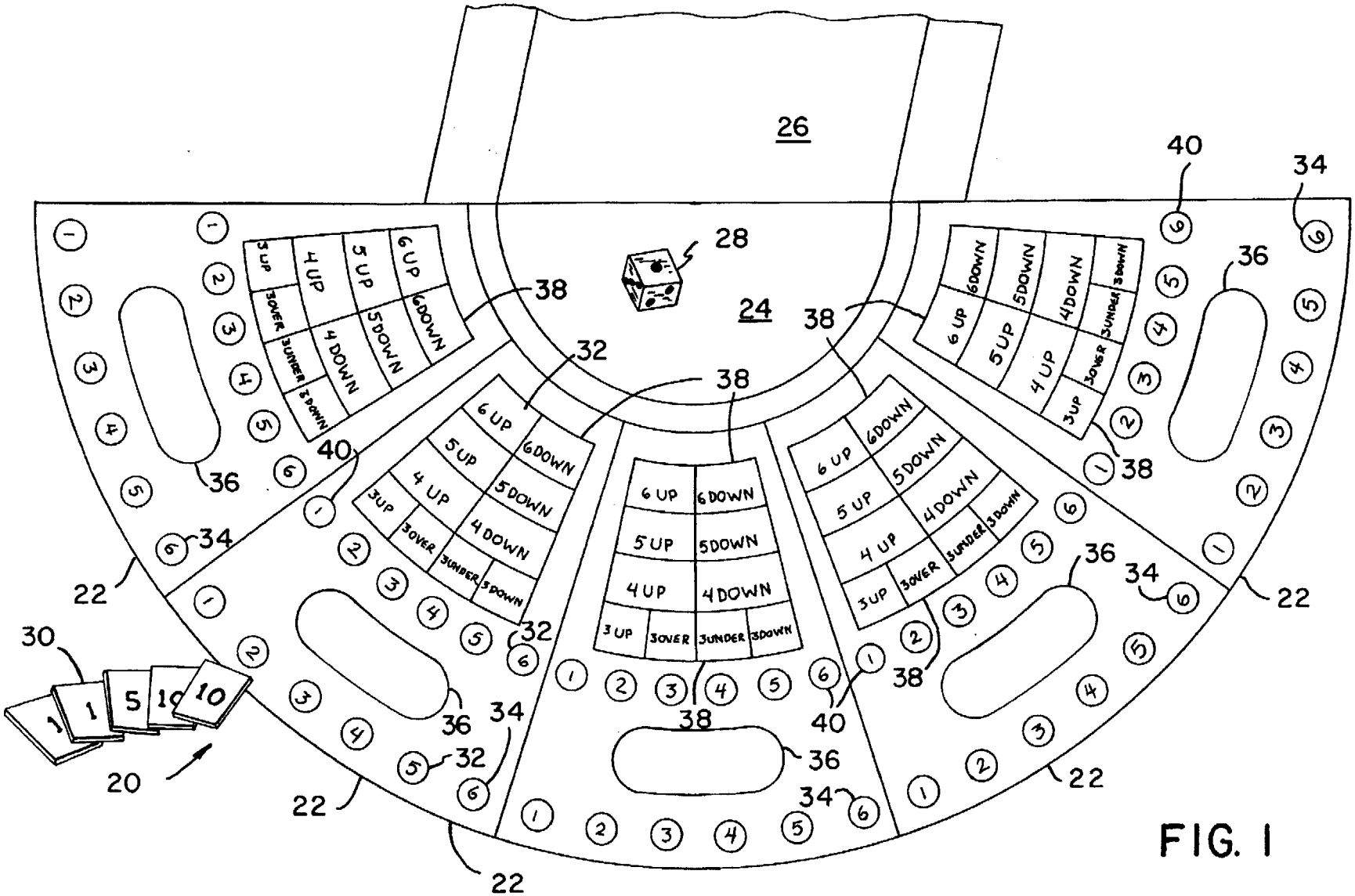
FIG. 1 is a plan view of the playing surface for the game of this invention.

The game of the present invention will be described with reference to FIGS. 1–3. FIG. 1 illustrates a gaming table 20 for use in playing the game of the present invention. The table 20 illustrates five betting stations 22 arranged around a dice pit 24. The dice pit 24 has a back stop 26 against which a die is thrown to begin the game. Before the die 28 is thrown, a shooter is selected and betting indicators 30 are placed on betting zones 32 which are printed on the table 20. Each player places betting indicators 30 on the betting zones 32 within their betting station 22. The betting zones 32 correspond to various wagers which are described below.

Each roll of the die 28 affects all players. Play consists of one or more players betting against the house. There is no limit on the number of players betting on a game other than the practical consideration of the amount of space available. The particular table 20 represented in FIG. 1 shows five betting stations 22 so that it would optimally accommodate up to five players, but tables could be produced with more or fewer betting stations if desired. Each of the players bets against the house and not against the other players. In fact, they are united by the fact that a winning game is good for all the players.

For any one game, only one of the players is the shooter and rolls the die 28. The shooter repeatedly rolls the die in a sequential manner until one of the following conditions is met, each face of the die is rolled or the same die face is rolled twice. The basic bet, which is herein referred to as a Type A bet, is that a particular number 1–6 will be rolled before a game ends. To make Type A bets, players place betting indicators 30 representing the size of their bets on the first ring 34 of numbers 1–6.

If the number in the first ring 34 on which a bet is placed is rolled, the player receives a payout of 2 for 1, which means that for each dollar bet the player receives his bet back plus one dollar. This 2 for 1 is defined as a return ratio of 2. During the play of the game, any Type A bets that are won are paid out by the gambling house, and together with the original amount bet are placed in that players winners circle 36. Any bets which are lost are collected by the house. If a game ends with all six faces of the die being rolled, each player receives an additional amount which is equal to the total betting indicators in that players winners circle 36. Thus, the return ratio for the rolling of all six faces of the die is two. The total return on a Type A bet of one dollar where all six faces of the die are rolled is the return ratio on the Type A bet times the return ratio for rolling all six die faces, or four dollars including the original dollar bet.

At the end of a game, the dice passes clockwise to the next player at the table to roll for the next game and so on.

A second type of bet herein referred to as a Type B bet is made by placing one or more betting indicators 30 on second betting zones 38. By placing betting indicators 30 on the betting zones 38 the players indicate they are placing bets with the house on the order of the first three, four, five, or six rolls of the dice.

A third type of bet herein referred to as a Type C bet is made by placing one or more betting indicators 30 on the second ring 40 of numbers 1–6. Type C bets are made before each throw of the dice and are won only if the next roll of the dice matches the number on which the bet was made.

Figure 3:
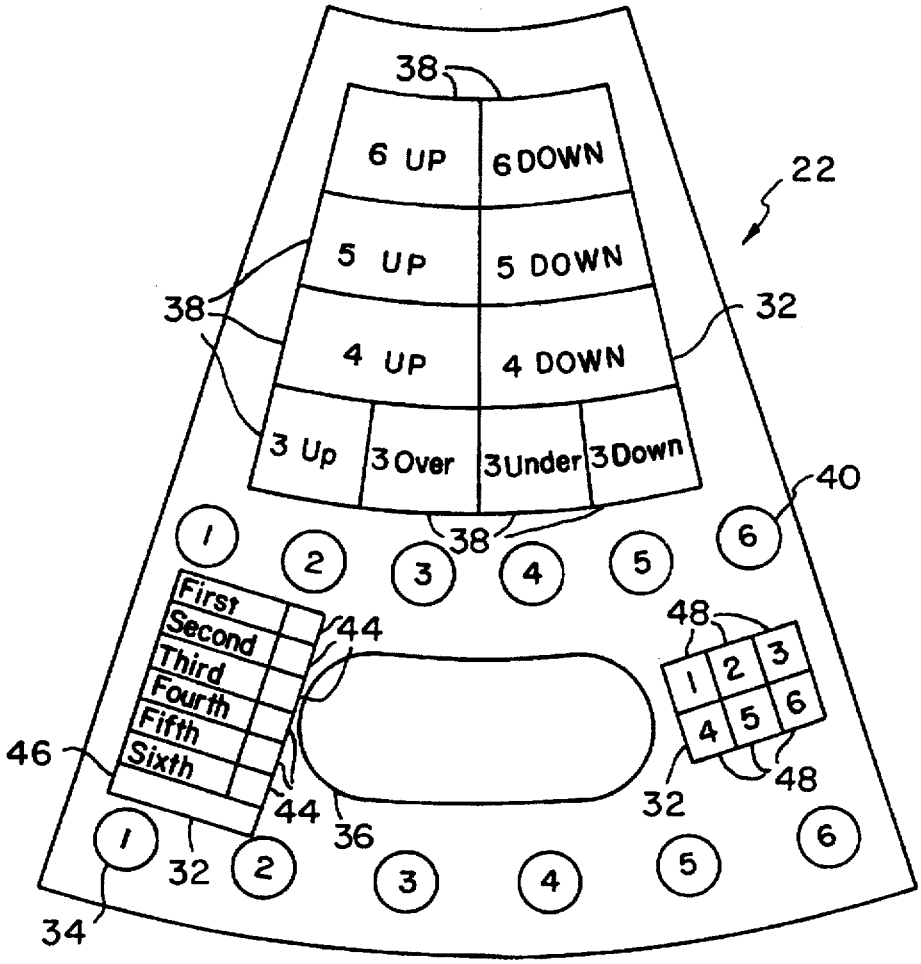
FIG. 3 is a plan view of a playing surface for a single player of the game of FIG. 1 showing additional bets that may be placed.
Figure 3:
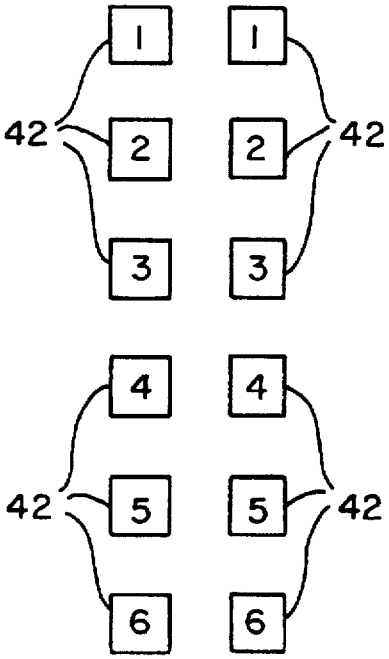

A fourth type of bet herein referred to as a Type D bet is made by arranging three or more number markers 42 shown in FIG. 3 on indicator zones 44. The marking numbers 42 are placed next to the words "first", "second", "third" and so on and indicate the player is betting that the first three or more rolls of the die will be in the order indicated. The size of the bet on a particular Type D bet is indicated by placing betting indicators 30 on the betting space 46 below the betting zone 44.

A fifth type of bet herein referred to as a Type E bet is made by placing betting indicators 30 on betting zones 48 which are numbered 1–6 and indicate that the player is betting that number of dice will be rolled before two rolls having the same value are rolled.

It is essential that the house be able to realize a modest edge in terms of the probabilities of the outcomes of the game. Yet those probabilities are not so obvious or unbalanced that players will avoid the game. For the casual player the precise percentage which the house collects is not critical. More important is the flow or rhythm of the game. This flow or rhythm results in an exciting game in which losses mount slowly with many opportunities to get ahead.

Thus, the precise odds given on a particular bet may be adjusted by the house to maximize overall return on the game considering both the house percentage and the amount wagered. By adjusting the house percentage on different bets, both novice and experienced players may be accommodated. The exciting high return bets often favored by novice players may have a larger return to the house, whereas the less exciting bets may be set to return a greater percentage of the player's money.

A large overhead board 50 shown in FIG. 2 displays the result of each successive roll of the die and helps the players keep track of the game 20. As each roll is made, the number corresponding to that roll is lit up. When a winning combination of rolls is made, the overhead board 50 may flash lights and sound alarms indicating a winning combination. The bright lights, colors and sounds serve to attract players to the game, and add to the excitement of the players engaged in the game.

DESCRIPTION OF THE PLAY OF THE GAME, ITS PAYOFFS AND PROBABILITIES

Play begins with all players placing the bets they wish on that game (Bet Types A or B) and/or on the first roll (Bet Type C).

Bet Type A. Players may bet on any or all of the numbers 1 through 6 to come up during the game. Type A bets pay 2 for 1 if they are won. As the basic bets of the game, these are the bets which are eligible for the bonus payments of Double Up or Triple Up.

Bet Type B. Players may bet on any or all (or none) of the ten combination bets: 3 Up, 3 Over, 3 Under, 3 Down, 4 Up, 4 Down, 5 Up, 5 Down, 6 Up and 6 Down. Type B bets pay anywhere from 5 for 1 on 3 Over and 3 Under, to 25,000 for 1 on 6 Up and 6 Down.

Bet Type C. Players may make Next Roll (insurance) bets on any of the numbers 1 through 6 to come up on the next roll. These bets pay 5 for 1.

The bets may be in any amounts or combinations the player chooses. They do not have to be equal or match the bets of the previous game or those of other players. A player may choose not to bet on any of the outcomes he prefers not to, but he should place at least one bet if he wishes to maintain his spot at the table (otherwise the casino may elect to offer that spot to someone who does wish to play). Once the bets of Type A and B are made, they are final for that game and may not be retracted or enhanced. The bets of Type C are made between rolls of the dice and apply only to the very next roll.

Once all bets are placed, the player whose turn it is to roll the dice for that game rolls, with the customary requirement that the dice hit the wall as in craps. Whatever number is rolled is a winner for Type A and Type C bets. A payoff on any successful Type A bets (equal to the amount of each bet) is combined with the bet and placed in the players winners circle 36. The winning number is illuminated on the overhead board 50 in the first roll column. If any Type C "next roll" bets were placed on the first roll, the successful bets are paid at 5 for 1 and collected by the player, while the unsuccessful bets are collected by the house.

Any Type C "next roll" bets the player may wish to place on the second roll are now made on the second ring 40. The shooter rolls again and there are two possible outcomes.

1. A number different from the first roll result comes up and is a Type A winner. Again, a payoff equal to any amounts bet on that number is combined with those bets and put in the winners circle. The winning number is illuminated on the overhead board in the second roll column.
2. The same number as was first rolled comes up again. This is a "crap out" and the game ends with all Type A bets on the five non-winning numbers going to the house. Likewise, any Type B bets are collected by the house (since the criteria for winning have not been met). The winners on the first roll Type A bets take their winnings from the winners circle at this time.

If any Type C "next roll" bets were placed on the second roll, the successful bets (regardless of whether a Type A winner or "crap out" was rolled) are paid off at 5 for 1 and the unsuccessful bets are collected by the house.

If the second roll produced a "crap out" and thus ended the game, the next game begins with the rolling of the dice passing clockwise to the next player and new bets being placed by the players however they wish. The rules and procedures for each game are otherwise identical.

However, if the second roll produced a second winning number (as it should ⅔ of the time), the players now place any Type C "next roll" bets they wish to on the third roll. The shooter rolls again and there are two possible outcomes.

1. A number different from either of the first two roll results comes up and is a Type A winner. Again, a payoff equal to any amounts bet on that number is combined with those bets and put in the winners circle. The winning number is illuminated on the overhead board in the third roll column.

In addition to the Type A winners on this roll, there can be Type B bet winners. The criteria for One of the following Type B bets will be met by a third successful roll (the other three will be lost):

i.) 3 Up—the first three rolls are all Type A winners and the winning numbers proceed in ascending order (e.g. 1-2-6 or 2-4-5 or 1-2-3 or 3-5-6, etc.). The payoff is 10 for 1.

ii.) 3 Down—Similar to 3 Up except the numbers for the first three rolls must be in strictly descending order (e.g. 5-4-3 of 6-4-1, etc.). The payoff is 10 for 1.

iii.) 3 Over—The first three rolls are all Type A winners and the second winning number is the largest (e.g. 1-5-2 or 5-6-4 or 2-6-5 or 2-3-1, etc.). The payoff is 5 for 1.

iv.) 3 Under—Similar to 3 Over except the second winning number is the smallest (e.g. 4-3-6 or 6-1-5 or 5-1-2, etc.). The payoff is 5 for 1.

The successful bets are paid off and collected by the player, while the unsuccessful Type B bets are collected by the house/casino.

2. The same number as either the first or second roll result comes up again. This is a "crap out" and the game ends with all Type A bets on the four non-winning numbers going to the house. Likewise, any Type B bets are collected by the house. The winners on the first two roll Type A bets take their winnings from the winners circle at this time.

If any Type C "next roll" bets were placed on the third roll, the successful bets (again, regardless of whether a Type A winner or "crap out" was rolled) are paid off at 5 for 1 and the unsuccessful bets are collected by the house.

If the third roll ended the game, the dice passes clockwise to the next player to roll and the next game begins.

However, if the third roll produced a third winning number (as it should two-thirds of the time), the players now place any Type C "next roll" bets they wish to on the fourth roll. The shooter rolls again and there are two possible outcomes.

1. A number different from each of the first three roll results comes up and is a Type A winner. Again, a payoff equal to any amounts bet on that number is combined with those bets and put in the winners circle. The winning number is illuminated on the overhead board in the fourth roll column.

There may also be Type B bet winners on 4 Up or 4 Down bets. The criteria for a 4 Up bet winning are: the first four rolls are all Type A winners and the winning numbers proceed in ascending order (e.g. 1-2-3-4 or 2-3-5-6 or 1-3-4-6, etc.). The payoff is 75 for 1. (Individual casinos may wish to modify this payoff to be more or less favorable/attractive to players. The "true odds" for this bet allow up to an 86 for 1 payoff, but then the casino's share of these bets would be almost nil.)

The criteria for a 4 Down bet winning are similar to 4 Up, except the numbers for the first four rolls must be in strictly descending order. The payoff is 75 for 1.

Note: Just because there were four Type A winning numbers, it is not the case that either a 4 Up or 4 Down winner must occur. Indeed, most often some other mixture of higher and lower numbers (e.g. 1-2-4-3 or 4-3-6-1 or 2-3-5-4, etc.) will have taken place. In these cases, the casino now collects the unsuccessful Type B bets.

2. The same number as one of the first three roll results comes up again. This is a "crap out" and the game ends with all Type A bets on the three non-winning numbers going to the house. Likewise, any Type B bets remaining (remember 3 Up, 3 Down, 3 Over and 3 Under were already resolved) are collected by the house. The winners on the first three roll Type A bets take their winnings from the winners circle at this time.

If any Type C "next roll" bets were placed on the fourth roll, the successful bets are paid off at 5 for 1 and the unsuccessful bets are collected by the house.

If the fourth roll ended the game, the dice passes clockwise to the next player to roll and the next game begins.

However, if the fourth roll produced a fourth winning number (as it should one-half of the time), the players now place any Type C "next roll" bets they wish to on the fifth roll. The shooter rolls again and there are again two possible outcomes.

1. A number different from each of the first four roll results comes up and is a Type A winner. Once again, a payoff equal to any amounts bet on that number is combined with those bets and put in the winners circle. The winning number is illuminated on the overhead board in the fifth roll column.

There may also be Type B bet winners on 5 Up or 5 Down bets. The criteria for a 5 Up bet winning are: the first five rolls are all Type A winners and the winning numbers proceed in strictly ascending order (e.g. 1-2-4-5-6 or 2-3-4-5-6 etc.). The payoff is 1000 for 1. (Again, individual casinos may wish to modify this pay off to be more or less generous to players. The "true odds" for this bet allow up to a 1296 for 1 payoff but this leaves nothing for the house.)

The criteria for a 5 Down bet winning are similar to 5 Up, except the numbers for the first five rolls must be in strictly descending order. The payoff is 1000 for 1.

2. The same number as one of the first four roll results comes up again. This is a "crap out" and the game ends with all Type A bets on the two non-winning numbers going to the house. Likewise, any Type B bets remaining are collected by the house. The winners on the first four roll Type A bets take their winnings from the winners circle at this time.

If any Type C "next roll" bets were placed on the fifth roll, the successful bets are paid off at 5 for 1 and the unsuccessful bets are collected by the house.

If the fifth roll ended the game, the dice passes clockwise to the next player to roll and the next game begins.

However, if the fifth roll produced a fifth winning number (as it should one-third of the time), the players now place any Type C "next roll" bets they wish to on the sixth roll. The shooter rolls again and there are two possible outcomes. (This time we will consider them in reverse order.)

1. The same number as one of the first five roll results comes up again. This is a "crap out" and the game ends with all Type A bets on the one non-winning number going to the house. Likewise, any Type B bets remaining are collected by the house. The winners on the first five roll Type A bets take their winnings from the winners circle.
2. A (the) number different from each of the first five roll results comes up and is a Type A winner. Just as was done on the previous winning rolls, a payoff equal to any amounts bet on that number is combined with those bets and put in the winners circle. The winning number is illuminated on the overhead board 50 in the sixth roll column accompanied by whatever amount of sound and light display the casino deems appropriate to the occasion. They are announcing the success of the players and thereby advertising the opportunities that come with playing this game.

In addition, the house now doubles or triples the entire amounts in each players winners circle. Thus, if a player had bet a total of $15.00 on all of his Type A bets for that game, there would have been $30.00 moved into the winners circle, which would now be matched by $30.00 more (or $60.00 if house rules provide for tripling). After this payoff had been made by the house, the players take their winnings, emptying the winners circle.

There may very rarely be Type B bet winners on 6 Up or 6 Down bets. The criteria for a 6 Up bet winning are very specifically that the six rolls produce roll results which go in the exact ascending order i.e. 1-2-3-4-5-6. The payoff is 25,000 for 1. Again, individual casinos may wish to modify this payoff to be more or less generous to players. The "true odds" for this bet allow up to a 46,656 for 1 payoff, but this leaves nothing for the house.

The criteria for 6 Down is that the six rolls result in strictly descending order i.e. 6-5-4-3-2-1. The payoff is 25,000 for 1.

If any Type C "next roll" bets were placed on the sixth roll, the successful bets are paid off at 5 for 1 and the unsuccessful bets are collected by the house.

This disposes of all the bets in the game and that game is over. The next game begins fresh with placement of entirely new Type A bets, etc. The only hold-over effect from the previous game is that a player who successfully gets six different roll results on his first six rolls, retains the roll of the dice for the next game. His fellow players, having benefitted from the doubled or triple payoff, will probably not begrudge him the honor and will no doubt prefer to try to ride his good luck.

OPTIONAL SUPPLEMENTAL SIDE BETS

The game may be expanded to include two other kinds of bets which are referred to as Type D and Type E bets.

Type D bets are made by a player specifying the first several rolls of the game. The player may specify the first two roll results, the first three roll results, the first four roll results, the first five roll results, or the first six roll results, before the first roll is made. Specifying just the first roll is a Type C bet, already part of the basic game.

For example, a player may specify 6-3-2 and if those are the results of the first three rolls in that order, then he wins. Or, the player may specify 1-4-1 and even though the game is lost for Type A results, he would still win. In order to be able to place bets on a number combination such as 1-4-1, two sets of number markers 42 shown in FIG. 3 are available to each player.

The payoff for Type D bets, where the first two rolls are specified and won is 25 for 1. For three rolls, the payoff is 125 for 1; for four rolls 625 for 1; for five rolls 3125 for 1; and for six rolls 15,625 for 1.

Type E bets are bets on the number of winning rolls in the game. The player can bet that there will be only one successful (Type A) roll, or precisely two, three, four, five, or six successful rolls.

The payoff for Type E bets are as follows:

precisely 1 successful roll: 5 for 1 precisely 2 successful rolls: 3 for 1 precisely 3 successful rolls: 3 for 1 precisely 4 successful rolls: 4 for 1 precisely 5 successful rolls: 10 for 1 precisely 6 successful rolls: 50 for 1

The die 28 may be colored in a distinctive fashion and the numbers on the board 50, the table 20, the first ring of numbers 34, and the second ring of numbers 40 may be colored to match the die 28 and the board 50. One typical color scheme would be to have the face containing one spot, red; the face with two spots, orange; three, yellow; four, green; five, blue; and six, purple. The die may be of larger size than typically used in Craps.

It is understood that the invention is not limited to the particular construction and arrangement of parts herein illustrated and described, but embraces such modified forms thereof as come within the scope of the following claims.

I claim:

1. A method of playing a dice game comprising the steps of:

providing at least one rolling die having multiple faces, each face having indicia which is different from every other face, and also providing betting indicators and a playing surface, the playing surface having a betting zone demarcated on it which uniquely identifies a particular face of the die;

placing at least one betting indicator on at least one betting zone;

rolling the die in a sequential manner until one of the following conditions is met, first condition, each face of the die is rolled, second condition, the same die face is rolled twice;

if the first condition is met, paying out winnings based on the number of betting indicators placed on at least one betting zone, times a first return ratio further multiplied by a second return ratio;

if the second condition is met paying out winnings based on the number of betting indicators placed on betting zones which correspond to die rolls which occurred prior to the second condition being met, times the first return ratio.

2. The method of claim 1 wherein the playing surface has secondary betting zones demarcated on it corresponding to each face of the die, and wherein at least one betting indicator is placed on one of said secondary betting zones before the first roll of the die or between any subsequent two rolls of the die, and wherein if a die roll immediately following the placement of the betting indicator matches the secondary betting zone on which a betting indicator is placed, paying out winnings based on the number of betting indicators times a third returned ratio substantially higher than the first return ratio.

3. The method of claim 1 wherein the die has six faces corresponding to the numbers one, two, three, four, five, and six, the die being rolled between two and six times until the first or second condition is met and wherein the playing surface has a betting zone demarcated on it corresponding to at least one bet selected from the group of bets comprising:

that the die will be rolled at least three times and that the second and third rolls will be higher then the previous roll;

that the die will be rolled at least three times and that the second and third rolls will be lower than the previous roll;

that the die will be rolled at least three times and that the second roll will be higher then the first and second rolls;

that the die will be rolled at least three times and that the second roll will be lower than the first and third rolls;

that the die will be rolled at least four times and that the second, third and fourth rolls will be higher than the previous roll;

that the die will be rolled at least four times and that the second, third and fourth rolls will be lower than the previous roll;

that the die will be rolled at least five times and that the second, third, fourth, and fifth rolls will be higher than the previous roll;

that the die will be rolled at least five times and that the second, third, fourth, and fifth rolls will be lower than the previous roll;

that the die will be rolled six times and the sequence of numbers rolled will be one, two, three, four, five, and six;

that the die will be rolled six times and the sequence of numbers rolled will be six, five, four, three, two, and one; and wherein at least one betting indicator is placed on one of said betting zones before the first roll of the die, and paying out winnings based on the number of betting indicators placed on tertiary betting zones which correspond to die rolls which occurred prior to the first or second conditions being met, and a return ratio which is inversely proportional to the probability of the outcome corresponding to the tertiary betting zone.

4. The method of claim 1 wherein the die has six faces corresponding to the numbers one, two, three, four, five, and six, the die being rolled between two and six times until the first or second condition is met and wherein the playing surface has a betting zone demarcated on it corresponding to at least one bet selected from the group of bets comprising:

that the die will be rolled precisely two times before the second condition is met;

that the die will be rolled precisely three times before the second condition is met;

that the die will be rolled precisely four times before the second condition is met;

that the die will be rolled precisely five times before the second condition is met;

that the die will be rolled precisely six times before the second condition is met;

that the first condition is met; and wherein at least one betting indicator is placed on one of said betting zones before the first roll of the die, and paying out winnings based on the number of betting indicators placed on the betting zones which correspond to die rolls which occurred prior to the first or second condition being met, and a return ratio which is inversely proportional to the probability of the outcome corresponding the bet placed.

5. The method of claim 1 wherein the die has six faces corresponding to the numbers one, two, three, four, five, and six, the die being rolled between two and six times until the first or second condition is met and wherein the playing surface has a betting zone demarcated on it corresponding to a bet that two or more numbers will be generated and that the numbers which are generated are in a player-selected sequence for the first two, three, four, five or six numbers generated; allowing players to place a bet according to the foregoing conditions;

and paying out winnings, if the die faces rolled correspond to the player selected sequence, based on the amount of the bet times a return ratio which is inversely proportional to the probability of the outcome corresponding to the bet placed.

6. The method of claim 1 wherein the first return ratio is two.

7. The method of claim 1 wherein the second return ratio is two.

8. The method of claim 1 wherein the second returned ratio is three.

9. The method of claim 1 wherein the die faces are color coded and further comprising a display board which is controlled to display the sequence of die faces rolled.

10. A method of playing a game of chance comprising the steps of:

generating a sequence of random numbers between one and six in a sequential manner until one of the following conditions is met: first condition, all the numbers between one and six are generated, second condition, the same number is generated twice;

before the sequence of numbers is generated allowing players to indicate bets on the basis that a particular number will appear in the sequence of numbers;

if the first condition is met paying out winnings based on the amount bet on the particular number if that number was generated, times a first return ratio further multiplied by a second return ratio; and if the second condition is met and if the particular number appears in the sequence of numbers, paying out winnings based on the amount bet on the particular number, times the first return ratio.

11. The method of claim 10 wherein before the first number is generated, and between each subsequent number generation, allowing players to place bets on what the next number generated will be, and paying out winnings if the number generated is the one bet on, based on the amount bet times a third return ratio substantially higher then the first return ratio.

12. The method of claim 10 wherein players are allowed to place bets before the first number is generated corresponding to at least one bet selected from the group of bets comprising:

that numbers will be generated at least three times and that the second and third number generations will be higher then all previous numbers generated;

that numbers will be generated at least three times and that the second and third numbers generated will be lower than all previous numbers generated;

that numbers will be generated at least three times and that the second roll will be higher then the first and second numbers generated;

that numbers will be generated at least three times and that the second roll will be lower than the first and third numbers generated;

that numbers will be generated at least four times and that the second, third and fourth numbers generated will be higher than all previously generated numbers;

that numbers will be generated at least four times and that the second, third and fourth numbers generated will be lower than all previously generated numbers;

that numbers will be generated at least five times and that the second, third, fourth, and fifth number generations will be higher than all previously generated numbers;

that numbers will be generated at least five times and that the second, third, fourth, and fifth number generations will be lower than the previous numbers generated;

that numbers will be generated six times and the sequence of numbers generated will be one, two, three, four, five, and six;

that numbers will be generated six times and the sequence of numbers generated will be six, five, four, three, two, and one; and paying out winnings if the sequence of numbers corresponds to a bet, based on the amount bet times a return ratio which is inversely proportional to the probability of the outcome corresponding to the bet placed.

13. The method of claim 10 wherein players are allowed to place bets of a selected amount, before the first number is generated corresponding to at least one bet selected from the group of bets comprising:

that precisely two numbers will be generated before the second condition is met;

that precisely three numbers will be generated before the second condition is met;

that precisely four numbers will be generated before the second condition is met;

that precisely five numbers will be generated before the second condition is met;

that precisely six numbers will be generated before the second condition is met;

that the first condition is met; and paying out winnings if the sequence of numbers corresponds to the bet, based on the selected amount bet times a return ratio which is inversely proportional to the probability of the outcome corresponding to the bet placed.

14. The method of claim 10 wherein players are allowed to place bets of a selected amount, before the first number is generated, that two or more numbers will be generated and that the numbers which are generated are in a player-selected sequence for the first two, three, four, five or six numbers generated;

and if the numbers generated are in the player-selected sequence, paying out winnings based on the selected amount bet times a return ratio which is inversely proportional to the probability of the outcome corresponding to the bet placed.

15. The method of claim 10 wherein the first return ratio is two.

16. The method of claim 10 wherein the second return ratio is two.

17. The method of claim 10 wherein the second return ratio is three.

18. A method of playing a game of chance comprising the steps of:

generating a sequence of random symbols out of a set of symbols in a sequential manner until one of the following conditions is met: first condition, all the symbols in the set are generated, second condition, the same symbol is generated twice;

before the sequence of symbols is generated allowing players to indicate bets of a selected amount, on the basis that a particular symbol will appear in the sequence of symbols;

if the first condition is met paying out winnings based on the amount bet on the particular symbol, times a first return ratio further multiplied by a second return ratio;

if the second condition is met and the particular symbol appeared in the sequence of symbols, paying out winnings based on the amount bet on the particular symbol, times the first return ratio.

19. The method of claim 18 wherein before the first symbol is generated and between each subsequent symbol generation allowing players to place bets on what the next symbol generated will be, and if the subsequent symbol generated is the symbol bet on, paying out winnings based on the amount bet times a third return ratio substantially higher then the first return ratio.

20. The method of claim 18 wherein players are allowed to place bets before the first symbol is generated corresponding to at least one bet selected from the group of bets comprising:

that precisely two symbols will be generated before the second condition is met;

that precisely three symbols will be generated before the second condition is met;

that precisely four symbols will be generated before the second condition is met;

that precisely five symbols will be generated before the second condition is met;

that precisely six symbols will be generated before the second condition is met;

that the first condition is met; and if the sequence of symbols corresponds to the bet, paying out winnings based on the amount bet times a returned ratio which is inversely proportional to the probability of the outcome corresponding to the bet placed.

21. The method of claim 18 wherein players are allowed to place bets before the first symbol is generated, that two or more symbols will be generated and that the symbols which are generated are in a player-selected sequence for the first two, three, four, five or six symbols generated;

and if the sequence of symbols is in the player-selected sequence, paying out winnings based on the amount bet times a returned ratio which is inversely proportional to the probability of the outcome corresponding to the bet placed.

* * * * *